US011865601B2

(12) United States Patent
Müller

(10) Patent No.: US 11,865,601 B2
(45) Date of Patent: Jan. 9, 2024

(54) DRAWING DIE FOR WORKING DEPRESSIONS OF A SHEET-METAL COMPONENT, IN PARTICULAR OF A MOTOR VEHICLE

(71) Applicant: Siegbert Müller, Eigeltingen (DE)

(72) Inventor: Siegbert Müller, Eigeltingen (DE)

( * ) Notice: Subject to any disclaimer, the term of this patent is extended or adjusted under 35 U.S.C. 154(b) by 0 days.

(21) Appl. No.: 17/761,904

(22) PCT Filed: Sep. 16, 2020

(86) PCT No.: PCT/EP2020/075908
§ 371 (c)(1),
(2) Date: Aug. 10, 2022

(87) PCT Pub. No.: WO2021/053037
PCT Pub. Date: Mar. 25, 2021

(65) Prior Publication Data

US 2023/0040640 A1 Feb. 9, 2023

(30) Foreign Application Priority Data

Sep. 18, 2019 (DE) ..... 102019125136.2

(51) Int. Cl.
*B21D 1/06* (2006.01)
*B21D 37/01* (2006.01)

(52) U.S. Cl.
CPC ..... *B21D 1/06* (2013.01); *B21D 37/01* (2013.01)

(58) Field of Classification Search
CPC ..... B21D 1/06; B21D 1/12; B21D 37/01
See application file for complete search history.

(56) References Cited

U.S. PATENT DOCUMENTS 6,722,179 B1 * 4/2004 Ventura ..... B21D 1/06 72/705
2003/0097869 A1 * 5/2003 Meichtry ..... B21D 1/06 72/705

FOREIGN PATENT DOCUMENTS

EP 1459814 A1 9/2004

OTHER PUBLICATIONS

Office Action dated Aug. 28, 2020, in corresponding German application No. 10 2019125 136.2.

* cited by examiner

*Primary Examiner* — Teresa M Ekiert
(74) *Attorney, Agent, or Firm* — Nath, Goldberg & Meyer; Jerald L. Meyer; Morgan D. Rosenberg

(57) ABSTRACT

The present invention relates to a drawing die (10) for working depressions(76) of a sheet-metal component (26), in particular of a motor vehicle, comprising a load-bearing structure (12), at least one supporting portion (16), which is fastened or can be fastened on the load-bearing structure (12) and with which the drawing die (10) can be placed on the sheet-metal component (26), characterized by a drawing means (28) which can be connected to the sheet-metal component (26) and is mounted on the load-bearing structure (12), and a moving device (36), which is mounted on the load-bearing structure (12) and by means of which the drawing means (28) can be moved in relation to the sheet-metal component (26), wherein at least the load-bearing structure (12) is formed from a fiber-reinforced plastic (52).

20 Claims, 4 Drawing Sheets

Figure 1:
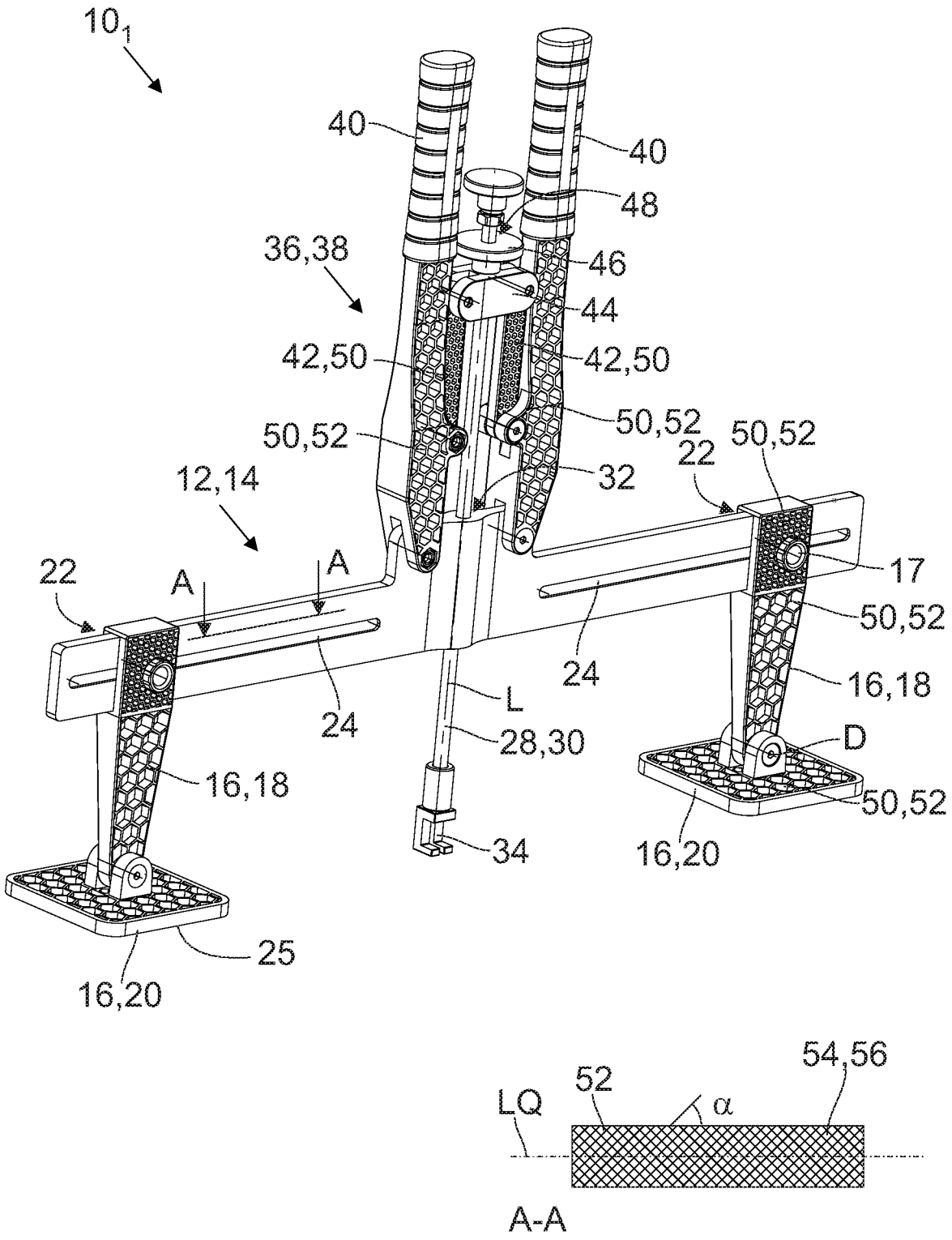

DRAWING DIE FOR WORKING DEPRESSIONS OF A SHEET-METAL COMPONENT, IN PARTICULAR OF A MOTOR VEHICLE

This is a National Phase Application filed under 35 U.S.C. 371 as a national stage of PCT/EP2020/075908, filed Sep. 16, 2020, an application claiming the benefit of German Application No. 10 2019 125 136.2 filed Sep. 18, 2019, the content of each of which is hereby incorporated by reference in its entirety.

The present invention relates to a drawing die for working depressions of a sheet-metal component, in particular of a motor vehicle.

Drawing dies of this type are always used when a sheet-metal component, in particular of outer skins of the body of a motor vehicle, has been damaged as a result of accidental contact with other objects and consequently shows depressions, in particular in the form of dents.

The present invention is described with reference to motor vehicles, but application to other sheet-metal components, for example, ships, trains and aircraft, is not excluded.

The drawing die comprises a load-bearing structure on which a drawing means is mounted. The drawing means serves, in particular, to transmit tractive forces and can be designed, for example, as a tension rod. The transmission of compressive forces is not excluded. The load-bearing structure is provided with supporting portions with which the drawing die can be placed on the surface of the sheet-metal component. The drawing means can be connected to the sheet-metal component, either directly or indirectly, in the area of the depression. In the case of a direct connection, the drawing means is spot-welded to the sheet-metal component. In the case of an indirect connection, a number of pull tabs are welded or bonded to the sheet-metal component, wherein, in particular, the pull tabs are connected to the drawing means in a positive manner. The drawing die has a moving device by which the drawing means can be moved substantially perpendicular to the surface of the sheet-metal component. The movement of the drawing means is transmitted to the sheet-metal component so that the depression is drawn out and the sheet-metal component subsequently has approximately the same shape as before the damage.

Drawing dies of this type are described, for example, in EP 0 544 191 A1, EP 0 783 926 A1 and EP 2 439 011 A1. The load-bearing structure of the drawing dies disclosed therein is made of metal, in particular steel or aluminum, which makes the drawing dies relatively heavy. Due to the weight, handling of the drawing dies is comparatively difficult since the user must use the corresponding strength to be able to position the drawing die as desired relative to the sheet-metal component. This results in comparatively rapid fatigue of the user, who is required to take breaks at regular intervals. The working times are extended as a result. As a consequence of both the high weight and the resulting user fatigue, there is a risk that the drawing die will be placed on the sheet-metal component with too great a force, which in addition to the damage mentioned above can also damage and in particular scratch the sheet-metal component. The removal of damage caused by the drawing die is associated with additional time and costs.

The task of one embodiment of the present invention, is to provide a drawing die with improved manageability that causes less fatigue for the user when compared to known drawing dies. Furthermore, the likelihood of damage stemming from the drawing die to the sheet-metal component that is to be worked, is to be reduced.

This task is solved with the features of claim 1. Advantageous embodiments are the subject of the sub-claims.

One embodiment of the invention relates to a drawing die for working depressions of a sheet-metal component, in particular of a motor vehicle, comprising

- a load-bearing structure,
- at least one supporting portion fixed or fixable to the load-bearing structure, by means of which the drawing die can be placed on the sheet-metal component,
- a drawing means connectable to the sheet-metal component and supported on the load-bearing structure, and
- a moving device mounted on the load-bearing structure, by means of which the drawing means can be moved relative to the sheet-metal component, wherein
- at least the load-bearing structure is formed from a fiber-reinforced plastic.

In addition to the load-bearing structure, the supporting portion and the moving device can, for example, at least partially consist of or comprise a fiber-reinforced plastic.

Due to the fact that at least the load-bearing structure is made of a fiber-reinforced plastic, it is, on the one hand, ensured that the forces occurring during working of the sheet-metal component are safely absorbed. On the other hand, the weight of the drawing dies is significantly reduced compared to known drawing dies, which significantly improves the manageability of the drawing dies according to the proposal. As a result of the reduced strength required when handling the drawing dies, the user tires less quickly. Both due to the reduced weight and due to the reduced fatigue of the user, it is possible to avoid or at least significantly reduce damage caused as a result of an over-zealous contact of the drawing dies with the sheet-metal component to be worked. The time and cost required to remove such damage is significantly reduced compared to known drawing dies.

According to a further embodiment, the plastic is reinforced with organic or inorganic reinforcing fibers. Organic or inorganic reinforcing fibers are available at low cost and can be incorporated into the plastic matrix in such a way that the tensile strength, in particular of the load-bearing structure, can be increased without unduly increasing the weight of the drawing die. Organic reinforcing fibers include aramid fibers, carbon fibers, polyester fibers, nylon fibers, polyethylene fibers, polymethyl methacrylate fibers or natural fibers such as sisal fibers, hemp fibers or flax fibers. Inorganic reinforcing fibers include basalt fibers, boron fibers, glass fibers, ceramic fibers, silica fibers, and/or quartz fibers.

In a further developed embodiment, the plastic may be reinforced with carbon fibers. Carbon fibers may be divided between isotropic and anisotropic carbon fibers. Anisotropic carbon fibers exhibit, in particular, high strengths and rigidities with simultaneously low elongation at break in the axial direction. Carbon fibers have a comparatively high modulus of elasticity and are therefore particularly suitable for reinforcement of the load-bearing structure.

In a further developed embodiment, the supporting portion can be formed from a fiber-reinforced plastic, wherein the plastic can be reinforced with organic or inorganic reinforcing fibers. The drawing die can be placed on the sheet-metal component using the supporting portion. During use of the drawing die, the supporting portion is largely subjected to pressure. The supporting portion is therefore subjected to lower loads than the load-bearing structure. In most cases, the sheet-metal component does however have a more or less pronounced curvature, so that torsional loads can be introduced into the supporting portion. These loads also manifest themselves in the supporting portion as tensile loads, which can be well absorbed by the reinforcing fibers.

In a further developed embodiment, the ratio of reinforcing fibers to plastic can be between 10% and 30%, in particular between 13% and 17% (w/w). It has been shown that within the specified weight-based ratio of reinforcing fibers to plastic in particular, the load-bearing structure is reinforced in a particularly effective manner.

According to an advanced embodiment, the plastic can be a thermoplastic, in particular a polyamide. A polyamide 6.6 has proved particularly suitable for this purpose. Thermoplastics can be processed using injection molding, so that, in this case, the supporting portion can be manufactured cost-effectively in large quantities. In so doing, the reinforcing fibers can be implemented as short fibers.

In another embodiment, the load-bearing structure and/or the supporting portion and/or the moving device may, at least in sections, have a honeycomb structure. The honeycomb structure also contributes to an increased rigidity, in particular of the load-bearing structure, of the supporting section and/or of the moving device without significantly increasing the weight of the drawing die.

A further developed embodiment is characterized in that the drawing means comprises a threaded rod that can be screwed into a corresponding threaded bore disposed on the moving device or cooperating with the moving device. The threaded rod and the threaded bore are designed to be self-locking. The threaded rod can be adjusted relative to the moving device along its longitudinal axis by rotation about its own longitudinal axis in such a way that the sheet-metal component to be worked can be optimally connected to the drawing die in the region of the depression. As a consequence, the threaded rod and the threaded bore allow the position of the drawing means to be adapted to the existing depth of the depression in the sheet-metal component to be worked.

According to a further embodiment, the threaded bore is arranged in a rotatable disc which abuts against the moving device. As mentioned, the threaded rod and the threaded bore are implemented as self-locking parts. This results in a comparatively tight thread pitch. As a result, comparatively many rotations of the threaded rod about its own longitudinal axis are necessary to adjust the threaded rod along its longitudinal axis. The adjustment process can likewise take a correspondingly long time. The disc may, for example, have a knurled surface so that it can be set into a self-rotating motion with a corresponding movement, and the speed of rotation may be comparatively high. The adjustment of the drawing means along its longitudinal axis can be noticeably accelerated by this, so that the adjustment process can be significantly shortened compared to known drawing dies.

A further embodiment is characterized in that the moving device comprises a lever arrangement for moving the drawing means. With the lever arrangement, the force to be applied by the user of the drawing die to eliminate the depression of the sheet-metal component to be worked, also referred to as drawing out the depression, can be significantly reduced, so that the fatigue of the user can be kept to a minimum.

According to a further embodiment, the load-bearing structure may comprise a cross member, wherein the one or more supporting means can be movably fastened or are movably fastened along the cross member to the same. Due to the movability of the supporting means along the cross member, the supporting means can be optimally arranged in relation to the depression of the sheet-metal component to be worked. The forces acting on the sheet-metal component can be optimally introduced into the sheet-metal component, taking into account the existing form of the depression.

According to an advanced embodiment, the plastic of the cross member is reinforced with organic or inorganic reinforcing fibers, in particular carbon fibers, wherein the reinforcing fibers are arranged directionally in the cross member. As mentioned, the supporting portions can be manufactured by injection molding, in which case short fibers can be admixed. In this case, the short fibers arrange themselves in a random manner, so that the supporting portions can be loaded isotropically, which is to say directionally-independently. Compressive and tensile forces are absorbed in equal measure.

The loads on the cross member occurring during operation of the drawing dies can be predicted relatively well, which offers the opportunity to align the reinforcing fibers in accordance with the expected loads. It should be borne in mind that the reinforcing fibers can only absorb tensile forces, not compressive forces. This allows the cross member to be manufactured with a minimum of material, so that weight can be spared.

According to a further embodiment, the plastic of the cross member is a thermosetting plastic, in particular an epoxy resin. Alternatively, vinyl esters or polyesters, in particular unsaturated polyesters, can also be used. In this embodiment, the cross member can be produced using a so-called "wet pressing process". Alternatively, the cross member can also be produced using a "prepreg manufacturing process", however, when compared to the wet pressing process, the prepreg manufacturing process places greater demands on the accuracy of the quantity of thermosetting plastic used, so that the wet pressing process is more tolerant of faults. In addition, more complicated component geometries such as grooves, fixing holes and elongated slots are easier to manufacture using the wet pressing process than using the prepreg manufacturing process.

In this, the thermosetting plastic forms the matrix surrounding the carbon fibers. The matrix serves to absorb compressive forces, whereas the carbon fibers serve to absorb tensile forces.

In a further developed embodiment, the supporting portion can have a first subsection wrapping around the cross member and a second subsection, wherein the second subsection is attached to the first subsection so as to be rotatable at least about an axis of rotation and comprising a support surface for placing on the sheet-metal component. In particular, if the sheet-metal component to be processed has curved sections, this embodiment makes it possible to optimally place the supporting portions, including over a large area, on the sheet-metal component. Damage brought about by the forces acting between the supporting portion and the sheet-metal component to be worked can be avoided in a particularly effective manner with this embodiment.

In a further developed embodiment, the drawing means and the moving device can be movably fastened or are movably fastened along the cross member to the same. This embodiment is, in particular, suitable for the removal of large-area depressions. In the case of such depressions, it may be necessary to draw out the depression at several points. In this embodiment, the drawing die can be placed in one position on the sheet-metal component to be worked. After completion of a drawing out operation, the moving device and the drawing means can be moved step-by-step along the cross member and the depression can once again be drawn out. A new repositioning of the drawing die on the sheet-metal component is therefore not necessary, reducing the time required to remove the depression.

In a further embodiment, the drawing means may have a hook-shaped connecting element at one end, by means of which pull tabs that are attached or attachable to the sheet-metal component can be connected to the drawing means. As mentioned at the outset, the drawing die can be connected either directly or indirectly to the sheet-metal component to be worked. In this embodiment, the drawing die is connected to the sheet-metal component using the pull tabs and thus indirectly. The pull tabs are hooked into the hook-shaped connecting element, allowing the tensile force applied to the drawing means by the moving device to be transmitted to the sheet-metal component and the depression to be drawn out.

A further embodiment is characterized in that the drawing die has an electrically operated heating device with which a mouthpiece arranged at one end of the drawing means can be heated in such a way that the mouthpiece can be connected to the sheet-metal component to form a welded joint. In this embodiment, the drawing die is connected directly to the sheet-metal component to be worked. This embodiment of the drawing die is suitable in particular for smaller depressions. The use of pull tabs is therefore unnecessary, so that less effort is required to eliminate depressions.

According to a further embodiment, the supporting portion surrounds at least one through hole which can be penetrated by the drawing means. As mentioned, the sheet-metal component is connected to the drawing die in the area of the depressions either directly or indirectly. In this embodiment, the supporting portion surrounds the depression either completely or at least for the most part. This embodiment is, in particular, likewise suitable for eliminating smaller depressions. Due to the fact that the depression is completely or at least largely surrounded by the supporting portion, the force applied to the sheet-metal component when the depression is pulled out is applied uniformly to the sheet-metal component, so that no permanent deformations are caused to the sheet-metal component as a result.

Exemplary embodiments of the invention are explained in more detail below with reference to the accompanying drawings.

Wherein

Figure 2:
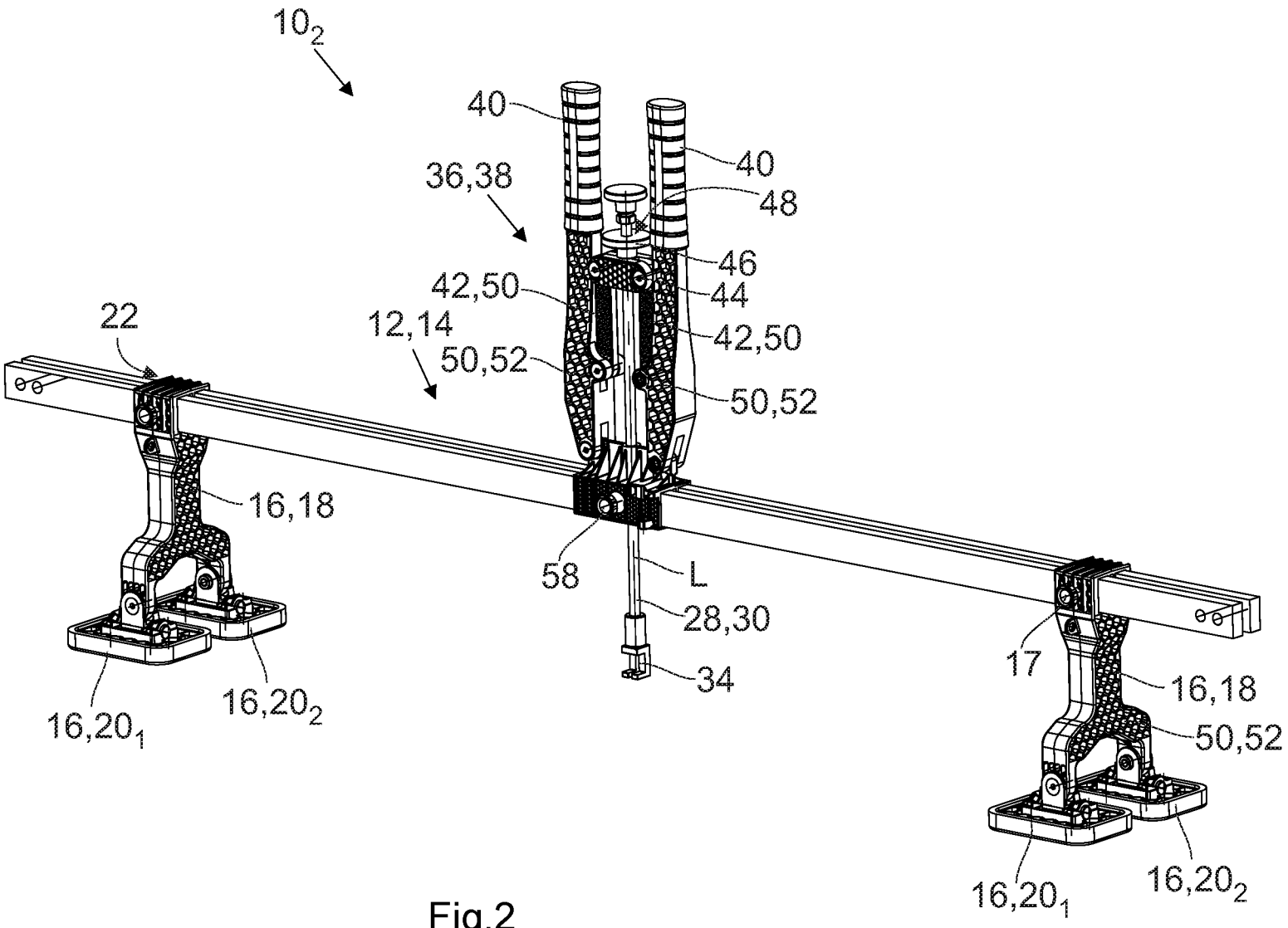
Figure 3:
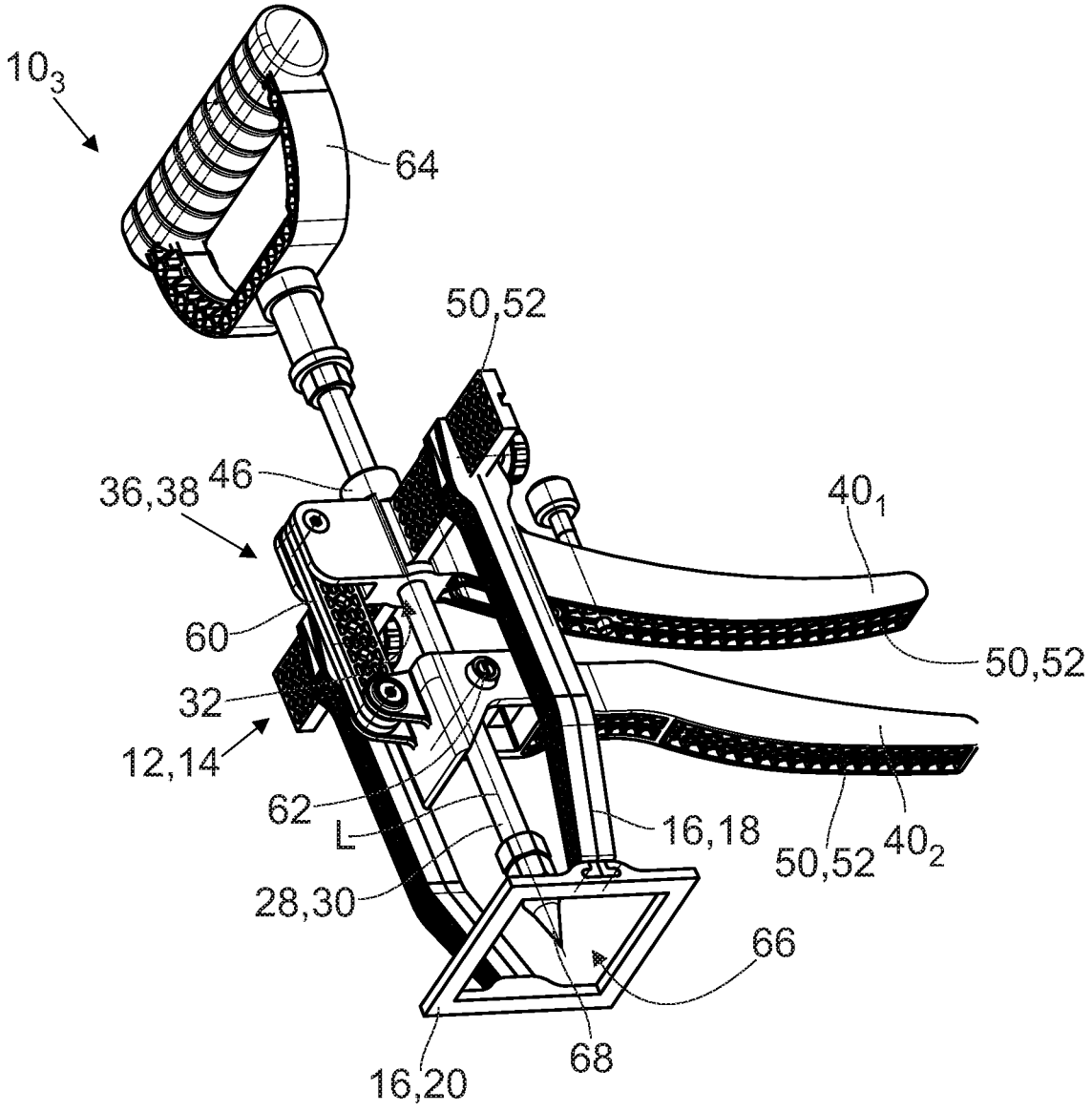
Figure 4:
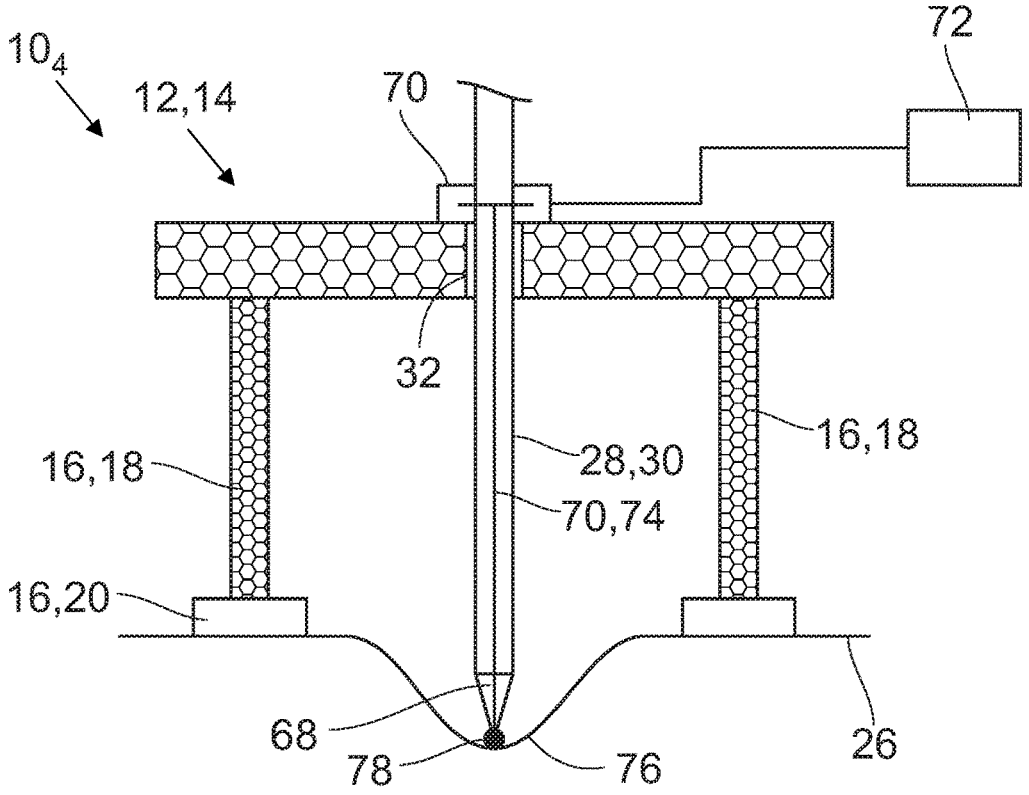
Figure 5:
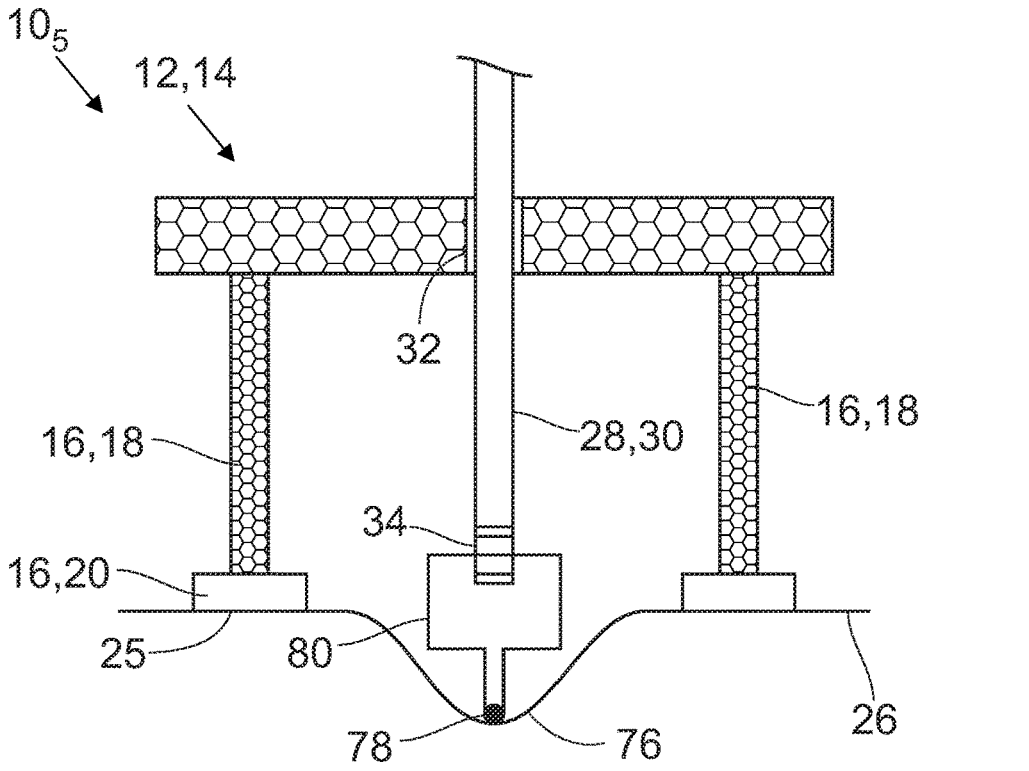

FIG. 1 shows a first embodiment of a drawing die according to the invention, FIG. 2 shows a second example of a drawing die according to the invention, FIG. 3 shows a third embodiment of a drawing die according to the invention, in each case on the basis of a perspective view, FIG. 4 shows a principal partial representation of a drawing die according to a fourth embodiment, and FIG. 5 shows a principal partial representation of a drawing dies according to a fifth embodiment.

In FIG. 1, a first embodiment of a drawing die $\mathbf{10}_1$ according to the invention is shown by means of a perspective view. The drawing die $\mathbf{10}_1$ comprises a load-bearing structure 12, which in the first embodiment comprises a cross member 14. Two supporting portions 16 are attached to the cross member 14, each supporting portion having a first subsection 18 and a second subsection 20. The first subsection 18 forms an aperture 22 through which the cross member 14 can pass. The supporting portion 16 can be moved along the cross member 14. The cross member 14 has two elongated slots 24, through each of which a set screw 17 can be passed, by means of which set screw the supporting portion 16 can be fixed in the desired position relative to the cross member 14. The second subsection 20 is rotatably attached to the first subsection 18 about an axis of rotation D and serves to support the drawing die $\mathbf{10}_1$ on a sheet-metal component 26 (see FIG. 4 and FIG. 5), which will be discussed in more detail below. For this purpose, the second subsection 20 forms a support surface 25.

Furthermore, the drawing die $\mathbf{10}_1$ comprises a drawing means 28, which in the first embodiment shown is implemented as a threaded rod 30, which is passed through a guide bore 32 arranged in the cross member 14 and which can be moved along a longitudinal axis L in the guide bore 32. With reference to the embodiment selected in FIG. 1, a connecting element 34 is connected to the drawing means 28 at the lower end of the drawing means 28, which connecting element is hook-shaped in the first embodiment example shown. The exact function of the connecting element 34 will be described in more detail below.

Furthermore, the drawing die $\mathbf{10}_1$ according to the invention is equipped with a moving device 36, with which the drawing means 28 can be moved along its longitudinal axis L. The moving device 36 comprises a lever arrangement 38, in the present example with two main levers 40, which are on the one hand rotatably attached to the cross member 14 and on the other hand rotatably attached to a respective secondary lever 42. The secondary levers 42 are, in turn, rotatably connected to a force transmission element 44 belonging to the moving device, which moving device is traversed by the threaded rod 30. The force transmission element 44 interacts with a disc 46, which has a threaded bore 48 into which the threaded rod 30 is screwed. By rotating the disc 46 about the longitudinal axis L of the threaded rod 30, the disc 46 can be moved along the threaded rod 30. Since the thread of the threaded rod 30 and the thread of the corresponding threaded bore 48 are self-locking, the disc 46 can abut against the force transmission element 44 when it comes into contact therewith. The disc 46 therefore acts as a kind of movable stop by means of which the forces emanating from the lever arrangement 36 can be transmitted to the drawing means 28. The position of the drawing means 28 relative to the cross member 14 can hereby be varied. Alternatively, the threaded bore 48 may also be arranged in the force transmission element 44 (not shown), into which the threaded rod 30 is screwed. In this case, the disc 46 can be dispensed with.

The drawing die $\mathbf{10}_1$ is shown in FIG. 1, in a position in which the drawing means 28 has been moved to the maximum upward position. With reference to the illustration selected in FIG. 1, the two main levers 40 are in a vertical position. If the main levers 40 are each respectively rotated by 90° so that they are approximately parallel to the cross member 14 and consequently approximately horizontal, with reference to the representation selected in FIG. 1, the drawing means 28 is moved downward. The most important movement in operation of the drawing dies $\mathbf{10}_1$ is to move the two main levers 40 from the approximately horizontal position back to the vertical position shown in FIG. 1, which moves the drawing means 28 upward with respect to the representation selected in FIG. 1.

In the first embodiment shown in FIG. 1, the main levers 40, the secondary levers 42 and the supporting portions 16 each have a honeycomb structure 50. The size of the honeycombs may be different. The first subsection 18 of the supporting portion 16 has a honeycomb structure 50 in the area of the aperture, in which the honeycombs are smaller than in the remainder of the first subsection 18. The honeycombs of the honeycomb structure 50 of the secondary levers 42 are smaller than the honeycombs of the honeycomb structure 50 of the main levers 40.

In addition, FIG. 1 shows a section of the cross member 14 in the inset, as viewed along the section plane A-A, such section is not to scale and is purely in principle. The section plane A-A runs perpendicular to the main load direction of the cross member 14, which runs approximately along the longitudinal axis L. It can be seen from this section A-A that the cross member 14 is made of a fiber-reinforced plastic 52. For this purpose, the plastic 52 has organic or inorganic reinforcing fibers 54, which, in particular, are implemented as carbon fibers 56. In so doing, the ratio by weight of reinforcing fibers 54 to plastic 52 is between 10% and 30%. The plastic in this case is a thermosetting plastic, for example, a polyester, a vinyl ester or epoxy resin. The carbon fibers 56 extend in the plane A-A or parallel thereto. When a load is exerted along the longitudinal axis L, the cross member 14 is subjected to bending, resulting in tensile forces in the cross member 14 which act approximately along the plane A-A or parallel thereto. Due to the orientation of the carbon fibers 56 in the cross member 14, these tensile forces can be well absorbed, so that the cross member 14 has high rigidity against bending.

As can also be seen from section A-A, the carbon fibers 56 each extend crosswise at an angle $\alpha$ of about 45° with respect to the longitudinal axis LQ of the cross member, so that the intersecting carbon fibers 56 form an angle of 90°. In operation, the drawing die $\mathbf{10}_1$ is placed with the support surface 25 on a sheet-metal component 26. In many cases, the surface of the sheet-metal component 26 is curved, so that the two supporting portions 16 are not exactly aligned with respect to the longitudinal axis LQ of the cross member, but rather are rotated with respect thereto. This introduces torsional moments into the cross member 14. As a result, tensile forces are generated in the cross member 14 which act at an angle of 45° to the longitudinal axis LQ of the cross member, which is to say exactly along the direction along which the carbon fibers 56 are also aligned. The carbon fibers 56 can therefore absorb these forces well, so that, in addition to the high bending rigidity already mentioned, a high torsional rigidity about the longitudinal axis LQ of the cross member is also achieved. Mats are used to align the carbon fibers 56. In this case, the carbon fibers 56 are formed as long fibers. The cross member 14 can be produced, for example, using the so-called "wet pressing process" or the "prepreg manufacturing process".

The supporting portions 16 and at least parts of the moving device 36 are also made of a fiber-reinforced plastic 52. In this case, too, the ratio by weight of reinforcing fibers 54 to plastic 52 is between 10% and 30%. In this case, the supporting portions 16 and the moving device 36 are made of a thermoplastic, for example, polyamide 6.6. The reinforcing fibers 54 can also be implemented as carbon fibers 56, but in this case as short fibers, so that the supporting portions 16 and the moving device 36 can be manufactured by injection molding.

In FIG. 2, a second embodiment example of the drawing die $\mathbf{10}_2$ according to the invention is also shown by means of a perspective view. The basic construction of the drawing die $\mathbf{10}_2$ according to the second embodiment largely corresponds to the construction of the drawing die $\mathbf{10}_1$ according to the first embodiment, which is why the main differences will be discussed below. Compared to the cross member 14 of the drawing die $\mathbf{10}_1$ according to the first embodiment example, the cross member 14 of the drawing die $\mathbf{10}_2$ according to the second embodiment example is significantly longer. In addition, the drawing means 28 and the moving device 36 are movable along the cross member 14, for which purpose a set screw 58 is provided, by means of which the position of the drawing means 28 and the moving device 36 can be fixed with respect to the cross member 14 once they have been brought into the desired position.

As in the first embodiment, the two supporting portions 16 are also movably mounted along the cross member 14.

The supporting portions 16 of the drawing die $\mathbf{10}_2$ according to the second embodiment example have two second subsections $\mathbf{20}_1$, $\mathbf{20}_2$, each of which is independently rotatably mounted about an axis of rotation D on the first subsection 18.

In the second embodiment example, the load-bearing structure 12, the supporting portions 16 and the moving device 36 are likewise made of a fiber-reinforced plastic 52. In the second embodiment example, the main levers 40 and the supporting portions 16 each also have a honeycomb structure 50. In addition, the force transmission element 44 also has a honeycomb structure 50.

FIG. 3 shows a third embodiment of the drawing die $\mathbf{10}_3$ according to the invention. In this embodiment, the lever arrangement 38 has a slightly different configuration than in the first and second embodiments of the drawing die $\mathbf{10}_1$, $\mathbf{10}_2$ according to the invention. The first main lever $\mathbf{40}_1$ of the lever arrangement 38 is fixedly attached to the cross member 14. The second main lever $\mathbf{40}_2$ is connected to the first main lever $\mathbf{40}_1$ via an intermediate lever 60. The intermediate lever 60 is rotatably connected to the first main lever $\mathbf{40}_1$ and rotatably connected to the second main lever $\mathbf{40}_2$. The second main lever $\mathbf{40}_2$, in turn, is rotatably connected to the drawing means 28 by means of a connecting screw 62. Consequently, the drawing means 28 follows the movement of the second main lever $\mathbf{40}_2$ relative to the first main lever $\mathbf{40}_1$. Furthermore, a handle element 64 is connected to the drawing means 28. A user can apply a force to the drawing means 28 via the handle element 64.

In this case, the second subsection 20 of the supporting portion 16 forms a through hole 66 which can be penetrated by the drawing means 28. With respect to the representation selected in FIG. 3, the drawing means 28 is connected to a mouthpiece 68 at the bottom end. The mouthpiece 68 can be heated by a heating device 70 which is not visible in FIG. 3.

The first main lever $\mathbf{40}_1$, the second main lever $\mathbf{40}_2$, the intermediate lever 60, the handle element 64 and the cross member 14 each have a honeycomb structure 50 and are made of or comprise a fiber-reinforced plastic 52.

A fourth embodiment example is shown in FIG. 4 by means of a principal partial representation. The fourth embodiment of the drawing die $\mathbf{10}_4$ according to the invention is largely similar to the third embodiment. FIG. 4 is intended, in particular, to illustrate the heating device 70, which is not visible in FIG. 3, and its mode of operation. The heating device 70 may be connected to an external power source 72 so that electrical power may be supplied to the heating device 70. In addition, the heating device 70 is connected to wires 74 which are passed through the drawing means 28 and lead to the mouthpiece 68. In so doing, the wires 74 are configured to heat substantially only the mouthpiece 68.

The essential operation of the drawing die $\mathbf{10}_3$, $\mathbf{10}_4$ according to the third and fourth embodiments can be seen from FIG. 4. The drawing die $\mathbf{10}_4$ is placed with the second subsections 20 of the supporting portion 16 on a sheet-metal component 26, which has a depression 76 that is to be worked and in particular eliminated. The sheet-metal component 26 may, in particular, be a part of the outer skin of the body of a vehicle, for example, the hood or the side door. The drawing means 28 is brought into a position in which the mouthpiece 68 comes into contact with the sheet-metal component 26. This position can be established, for example, by moving the aforementioned disc 46 to a position such that it rests against the force transmission element 44 in the position shown (see, in particular, FIG. 1 and FIG. 2). Subsequently, the heating device 70 is activated so that the mouthpiece 68 is heated in the area in which it comes into contact with the sheet-metal component 26. In the process, the mouthpiece 68 is heated to such an extent that a welded joint 78 is formed between the mouthpiece 68 and the sheet-metal component 26. The heating device 70 is then deactivated, allowing the weld joint 78 to cool and solidify. Thereafter, a force directed substantially perpendicular to the sheet-metal component 26 and along the longitudinal axis L of the drawing means 28 is applied to the drawing means 28, in particular using the lever arrangement 38. In the embodiments shown in FIG. 1 and FIG. 2, the two main levers 40 are moved from a substantially horizontal position to a substantially vertical position, which are respectively shown in FIG. 1 and FIG. 2.

In the third embodiment of the drawing dies $\mathbf{10}_3$ shown in FIG. 3, the second main lever $\mathbf{40}_2$ is moved towards the fixed first main lever $\mathbf{40}_1$. Alternatively, the handle element 64 can also be pulled. In so doing, the sheet-metal component 26 follows the movement of the drawing means 28 in the region of the depression 76. The drawing means 28 is moved until the mouthpiece 68 is approximately aligned with the rest of the sheet-metal component 26 in the region in which it comes into contact with the sheet-metal component 26. In this manner, it is possible to eliminate the depression 76 so that the worked sheet-metal component 26 no longer has a depression 76 or at least no visible depression 76.

The welded joint 78 can transmit comparatively high tensile forces, but it fails quickly when subjected to bending or torsion. In order to be able to separate once again the mouthpiece 68 from the sheet-metal component 26 after working the piece, the drawing die $\mathbf{10}_4$ can be rotated or tilted, which breaks the welded joint 78.

A fifth embodiment example of the drawing die $\mathbf{10}_5$ according to the invention is shown in FIG. 5, here too on the basis of a principle partial illustration. The fifth embodiment corresponds essentially to the first and second embodiments of the drawing dies $\mathbf{10}_1$, $\mathbf{10}_2$. FIG. 5 serves, in particular, to explain the function of the connecting element 34. It should be noted that the drawing die $\mathbf{10}_1$, $\mathbf{10}_2$ according to the first and second embodiment examples does not have a heating device 70. For this reason, the drawing means 28 also cannot be connected to the sheet-metal component 26 through formation of a welded joint 78. Instead of a welded joint, a number of pull tabs 80 are connected to the sheet-metal component 26 forming a spot welded joint 78 in the area of the depression 76.

Depending on the size of the depression 76, it may be sufficient to connect only one pull tab 80 in the depression 76 to the sheet-metal component 26, although the use of multiple pull tabs 80 is, in particular, recommended for larger depressions 76.

Once the pull tabs 80 are connected to the sheet-metal component 26, the drawing die $\mathbf{10}_1$ is positioned so that the hook-shaped connecting element 34 can positively engage the pull tab 80. Subsequently, as noted with reference to FIG. 4, the drawing means 28 is moved away from the sheet-metal component 26 along its longitudinal axis L using the lever arrangement 38 until the welded joint 78 is approximately aligned with the remainder of the sheet-metal component 26 outside the depression 76. When the working of the sheet-metal component 26 is finished, the engagement between the connecting element 34 and the pull tab 80 is released and the drawing die $\mathbf{10}_5$ is removed. The welded joint 78 between the pull tab 80 and the sheet-metal component 26 may be broken by twisting and/or bending so that the pull tab 80 may be separated from the sheet-metal component 26.

LIST OF REFERENCES

10 Drawing die
$\mathbf{10}_1$ to $\mathbf{10}_5$ Drawing die
12 Load-bearing structure
14 Cross member
16 Supporting portion
17 Set screw
18 First subsection
20 Second subsection
$\mathbf{20}_1$, $\mathbf{20}_2$ Second subsection
22 Aperture
24 Elongated slot
25 Support surface
26 Sheet-metal component
28 Drawing means
30 Threaded rod
32 Guide bore
34 Connecting element
36 Moving device
38 Lever arrangement
40 Main lever
$\mathbf{40}_1$, $\mathbf{40}_2$ Main lever
42 Secondary lever
44 Force transmission element
46 Disc
48 Threaded bore
50 Honeycomb structure
52 Fiber-reinforced plastic
54 Reinforcing fibers
56 Carbon fiber
58 Set screw
60 Intermediate lever
62 Connecting screw
64 Handle element
66 Through hole
68 Mouthpiece
70 Heating device
72 Power source
74 Wire
76 Depression
78 Welded joint
80 Pull tabs
D Axis of rotation
L Longitudinal axis
LQ Cross member-Cross member
α Angle reinforcing fibers

The invention claimed is:

1. A drawing die (10) for working depressions (76) of a sheet-metal component (26), comprising:

a load-bearing structure (12);

at least one supporting portion (16) which is fastened or can be fastened on the load-bearing structure (12), and with which the drawing die (10) can be placed on the sheet-metal component (26);

drawing means (28) that is connectable to the sheet-metal component (26) and mounted on the load-bearing structure (12); and a moving device (36) mounted on the load-bearing structure (12), by means of which moving device the drawing means (28) can be moved relative to the sheet-metal component (26), wherein at least the load-bearing structure (12) is made of a fiber-reinforced plastic (52), wherein the supporting portion (16) is formed from the fiber-reinforced plastic (52), wherein the fiber-reinforced plastic (52) is reinforced with organic or inorganic reinforcing fibers (54), and wherein a ratio of reinforcing fibers (54) to plastic in the fiber-reinforced plastic (52) is between 10% (w/w) and 30% (w/w).

2. The drawing die (10) according to claim 1, characterized in that the plastic (52) is reinforced with carbon fibers (56).

3. The drawing die (10) according to claim 1, characterized in that the ratio of reinforcing fibers (54) to plastic in the fiber-reinforced plastic (52) is between 13% (w/w) and 17% (w/w).

4. The drawing die (10) according to claim 3, characterized in that the plastic is a thermoplastic material.

5. The drawing die (10) according to claim 4, wherein the plastic comprises polyamide.

6. The drawing die (10) according to claim 1, characterized in that the load-bearing structure (12) and/or the supporting portion (16) and/or the moving device (36) has, at least in sections, a honeycomb structure (50).

7. The drawing die (10) according to claim 1, characterized in that the drawing means (28) comprises a threaded rod (30), which threaded rod can be screwed into a corresponding threaded bore (48) arranged on the moving device (36) or cooperating with the moving device (36).

8. The drawing die (10) according to claim 7, characterized in that the threaded bore (48) is arranged in a rotatable disc (46) which abuts against the moving device (36) or the load-bearing structure (12).

9. The drawing die (10) according to claim 1, characterized in that the moving device (36) comprises a lever arrangement (38) for moving the drawing means (28).

10. The drawing die (10) according to claim 1, characterized in that the load-bearing structure (12) comprises a cross member (14), wherein the one or plurality of supporting portions (16) is/are movably attachable to or secured along the cross member (14).

11. The drawing die (10) according to claim 10, characterized in that the plastic (52) of the cross member (14) is reinforced with organic or inorganic reinforcing fibers (54), wherein the reinforcing fibers are arranged directionally in the cross member (14).

12. The drawing die (10) according to claim 11, wherein the organic or inorganic reinforcing fibers (54) comprise carbon fibers.

13. The drawing die (10) according to claim 10, characterized in that the plastic (52) is a thermosetting plastic.

14. The drawing die (10) according to claim 13, wherein the thermosetting plastic comprises an epoxy resin.

15. The drawing die (10) according to claim 10, characterized in that the supporting portion (16) has a first subsection (18) that wraps around the cross member (14) and a second subsection (20), wherein the second subsection (20) is rotatably attached to the first subsection (18) at least about an axis of rotation (D) and comprises a support surface (25) for resting on the sheet-metal component (26).

16. The drawing die (10) according to claim 10, characterized in that the drawing means (28) and the moving device (36) are movably attached or attachable along the cross member (14).

17. The drawing die (10) according to claim 1, characterized in that the drawing means (28) has a hook-shaped connecting element (34) at one end, with which pull tabs (80), which are fastened or can be fastened to the sheet-metal component (26), can be connected to the drawing means (28).

18. The drawing die (10) according to claim 1, characterized in that the drawing die (10) has an electrically operated heating device (70) with which a mouthpiece (68) arranged at one end of the drawing means (28) can be heated in such a way that the mouthpiece (68) can be connected to the sheet-metal component (26) to form a welded joint (78).

19. The drawing die (10) according to claim 18, characterized in that the supporting portion (16) encloses at least one through hole (66) which can be penetrated by the drawing means (28).

20. The drawing die (10) according to claim 1, wherein the sheet-metal component (26) is a sheet-metal component of a motor vehicle.

* * * * *